United States Patent [19]

Petree

[11] Patent Number: 4,669,555

[45] Date of Patent: Jun. 2, 1987

[54] DOWNHOLE CIRCULATION PUMP

[75] Inventor: Allen R. Petree, Hagerman, N. Mex.

[73] Assignee: Conoco Inc., Ponca City, Okla.

[21] Appl. No.: 856,557

[22] Filed: Apr. 28, 1986

[51] Int. Cl.[4] ..... E21B 4/02; E21B 4/20

[52] U.S. Cl. ..... 175/97; 175/107; 418/48

[58] Field of Search ..... 175/92, 93, 97, 107; 418/48, 220

[56] References Cited

U.S. PATENT DOCUMENTS

| | | | |
|---|---|---|---|
| 2,828,945 | 4/1958 | New | 255/4 |
| 3,766,992 | 10/1973 | Tiraspolsky et al. | 175/107 |
| 3,912,426 | 10/1975 | Tschirky | 418/48 |
| 3,982,858 | 9/1976 | Tschirky | 418/48 |
| 3,999,901 | 12/1976 | Tschirky | 418/48 |
| 4,011,917 | 3/1977 | Tiraspolsky et al. | 175/107 |
| 4,059,165 | 11/1977 | Clark | 175/107 |
| 4,221,036 | 9/1980 | McCoy et al. | 29/156.4 |
| 4,305,474 | 12/1981 | Farris et al. | 175/73 |
| 4,397,619 | 8/1983 | Alliquander et al. | 418/48 |
| 4,492,276 | 1/1985 | Kamp | 175/61 |
| 4,493,383 | 1/1985 | Williams et al. | 166/105.1 |
| 4,592,427 | 6/1986 | Morgan | 418/48 |

OTHER PUBLICATIONS

"Bull Dog Bailer", Bull Dog Tool Inc. (brochure).

*Primary Examiner*—Stephen J. Novosad
*Assistant Examiner*—Terry Lee Melius
*Attorney, Agent, or Firm*—Richard K. Thomson

[57] ABSTRACT

A pump for circulating fluids downhole. The rotor of a positive displacement pump transmits torque from the upper drill string section to a tool attached to the lower end of the pump. Bow springs prevent the stator portion of the pump from rotating in the wellbore. Fluid is counterflowed up the interior of the drill string by the positive displacement pump through a check valve into a settling chamber. Cuttings or other solids settle out of the fluid and the fluid is then pumped out through one or more discharge ports to the lowermost end of the drill string.

17 Claims, 3 Drawing Figures

DOWNHOLE CIRCULATION PUMP

BACKGROUND AND SUMMARY OF THE INVENTION

The present invention is directed to a positive displacement pump for circulating fluids downhole. More particularly, the present invention is directed to a progressing cavity fluid displacement pump for circulating drilling or other fluid downhole in wellbores where normal fluid circulation is either undesirable or impossible (e.g., where the bottomhole pressure is too low). The circulating pump of the present invention is particularly well adapted for use in cased wells to drill out plugs or packers or to remove fill or scale. This circulating pump might also be used in open wells if the hole is sufficiently stable and of sufficiently constant size.

In normal drilling operations, or the like, drilling fluid is circulated from the surface, down the drill string (inside or out) back to the surface (outside or inside the drill string). The drilling fluid performs at least two essential functions:

(1) the fluid functions as a lubricant coolant keeping down the temperature of the bit and the rock surrounding it (i.e., prevents the bit from burning up) and, (2) the fluid carries the cuttings up the wellbore to the surface removing them from the cutting area (i.e., the drilling fluid reduces the likelihood of sticking the bit in the hole).

In certain drilling/milling operations, or the like, normal circulation of drilling fluid may be impossible or undesirable. Examples of the former include drilling out plugs, packers, etc. or removing fill or scale from a well casing or tubing where there is insufficient clearance between the casing (or the tubing) and the drill string to permit normal circulation, or enlarging the diameter of wellbores where it is not possible to provide closed-loop circulation. An example of circumstances in which circulation would be undesirable might include circulation of acids or other chemicals to remove scale or parafin where normal circulation would be too costly as a result of the amount of fluid required.

In some such situations, the drilling/milling operation is performed without drilling fluid circulation risking burn up and jamming of the tool. Another solution to the problem takes the form of a downhole pump that requires reciprocation of the drill string to effect operation. Such "stroking" of the tubing requires shutdown of the drilling/milling operation and risks sticking the bit in the accumulated cuttings. Further, the valves in this pump are subject to jamming by the cuttings, requiring the entire drill string to be pulled to correct. Lastly, since this pump is operated intermittently, the potential arises for burning up the bit due to the lack of timely stroking.

The present invention overcomes these problems. The present invention utilizes a positive displacement pump (preferably of the progressing cavity type) to circulate drilling fluid downhole. Each end of the rotor has a longitudinally extending straight portion to enable each end of the rotor to be connected by first and second attachment means to an upper element and a lower element, respectively. The second attachment means includes a sliding sprocket to prevent the axial compression of the drill string, that occurs when the drill is engaged, from being transmitted to the rotor (which could potentially cause jamming and/or increased wear on the stator). The cylindrical casing housing the stator is maintained stationary (i.e., does not rotate) by virtue of bow strings engaging the cased (or uncased) wellbore. Rotary force is transmitted from the upper element to the lower element through the stator by the rotor itself.

The cuttings-ladened drilling fluid is pumped upwardly through a check valve into a sediment settling chamber and then out of the drill string through one or more discharge ports to be returned to the lowermost end of said drill string.

Other features, characteristics and advantages of the present invention will become apparent after a reading of the following description.

DETAILED DESCRIPTION OF THE PREFERRED EMBODIMENTS

Figure 1:
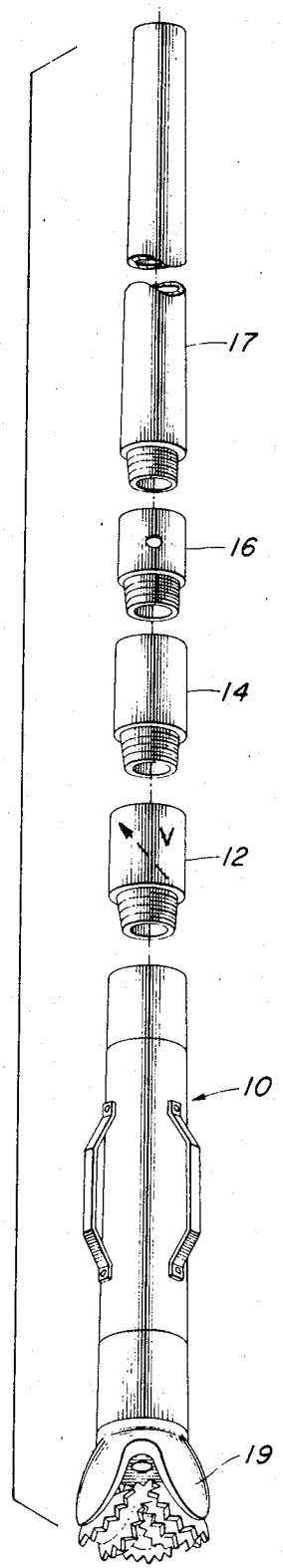
FIG. 1 is an exploded isometric view of a portion of a drill string employing the circulating pump of the present invention.

The downhole circulation pump of the present invention is seen in its entirety in FIG. 1 and comprises an active pumping section shown generally at 10, a check valve section 12, a sediment holding chamber 14 and a discharge port section 16 attached to the end of drill string 17. Sediment holding chamber 14 comprises one or more standard sections of drill string whose length will be determined by the requirements of the particular application. A drill bit 19 is shown in FIG. 1 attached to the lower end of the pumping section 10. Bit 19 may take the form of a mill or any other tool for which localized downhole fluid circulation would be beneficial. While it is preferred that check valve section 12, sediment holding chamber 14 and discharge port 16 are separate sections for flexibility of drill string assembly, obviously two or more of these elements could be combined into a single section without departing from the scope of the invention.

Figure 2:
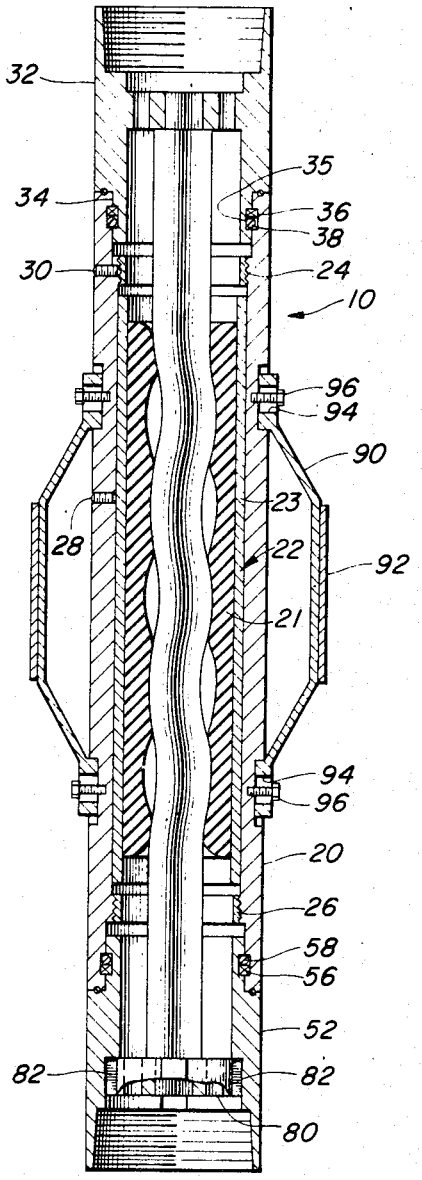
FIG. 2 is a cross-sectional side view of the operative portion of the circulating pump of the present invention.
Figure 3:
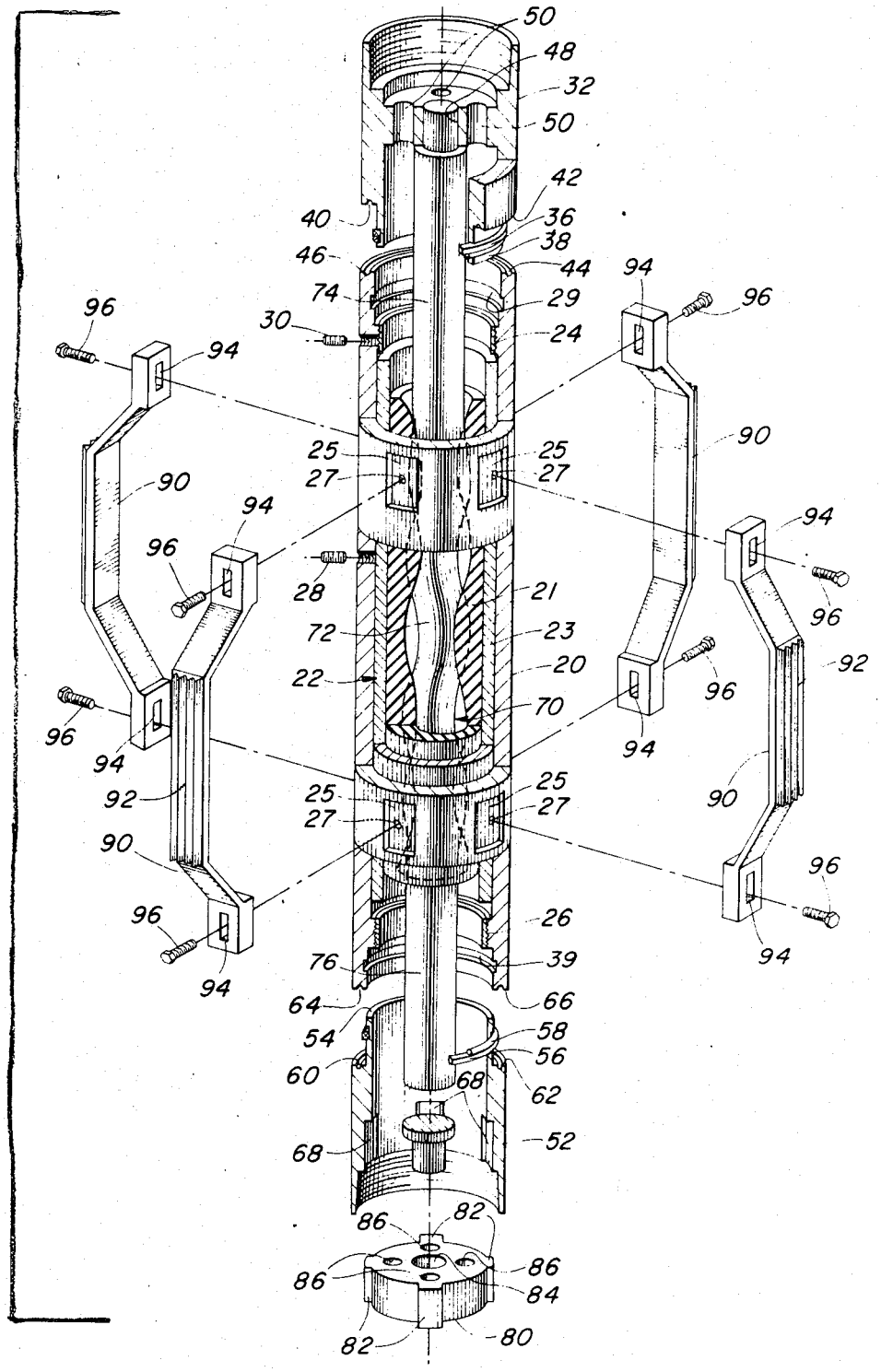
FIG. 3 is a partially exploded isometric view of the operative portion of the pump shown if FIG. 2, in partial section and with some portions broken away to enhance understanding.

The pumping section 10 is shown in greater detail in FIGS. 2 and 3. A cylindrical housing or casing 20 defines the external dimensions of the pump. Preferably, the outer diameter of the casing 20 is generally equal to that of the drill string being run. Inside the cylindrical casing 20, a stator 22 is non-rotatably secured. Stator 22 is made of rubber or similar elastomeric material 21 and a steel sleeve 23 to which it is bonded. Sleeve 23 is maintained in longitudinal position by retaining rings 24 and 26 which threadingly engage the interior or cylindrical casing 20. One or more set screws 28 secure stator 22 against rotation within the casing 20 by engaging sleeve 23. The retaining rings 24,26 and set screws 28 permit the stator 22, which is subject to significant wear, to be quickly replaced. Set screws 30 (one shown) maintain retaining rings 24,26 in position preventing dislodging due to vibration or other induced undesired rotation.

A first attachment means or sleeve 32 is provided for threadingly securing the pump 10 to the upper element in the drill string. It will be understood that the terms "upper" and "lower" refer to directions in a normal vertical drill string but are not intended to limit the application of the present invention only to use in vertical wellbores. First attachment sleeve 32 has reduced diameter portion 34 with an annular groove 35 formed in the reduced diameter portion for receiving an annular seal 36. An annular spring 38 is positioned within the groove 35 with seal 36 to keep the seal 36 from flattening out against portion 34 and losing its capability to seal. The inner periphery of casing 20 may optionally be provided with a groove 29 to improve the performance of seal 36. A bearing race or groove 40 (FIG. 3) is formed in the laterally-extending shoulder 42 created adjacent reduced diameter portion 34. Bearing race 40 coacts with bearing race 44 formed on the upper end surface 46 of cylindrical casing 20. Bearing races 40 and 44 receive a set of ball bearings (not shown) which serve not only as rotary bearings but as axial thrust bearings for reasons discussed hereafter.

A second attachment means or sleeve 52 threadingly engages tool 19. Sleeve 52 has a reduced diameter portion 54 which, like its counter part, is equipped with an annular groove which receives seal 56 and an annular spring 58 to prevent the seal from flattening. A second groove 39 may optionally be provided to improve the performance of seal 56. Depending on the performance characteristics of the tool, a small amount of fluid leakage through seals 36 and 56 may be desirable to cool the ball bearings. A bearing race 60 is formed in laterally-extending shoulder 62 which cooperates with race 64 formed in the opposite end surface 66 to receive ball bearings (not shown) which function as both rotary and thrust bearings, as before.

A rotor 70 extends through the stator 22 and includes a helical section 72 sandwiched by upper and lower straight sections 74 and 76. Preferably, the stator 22 is formed with either a double helix having the same pitch as the helix of the rotor 70 or the stator 22 may be formed with a single helix having twice the pitch of the rotor's helix. The upper straight section 74 is threadingly received in aperture 48 of sleeve 32. A plurality of throughbores 50 are positioned around aperture 48 for purposes detailed below. Slide sprocket 80 which has laterally-extending teeth 82 which are received in keyways 68 in sleeve 52, is threadingly received on the lower end of rotor 70 by aperture 84. A plurality of throughbores 86 are positioned around aperture 84 in a manner similar to that in which bores 50 are positioned around aperture 48. The threads on both ends of rotor 70 are right-handed such that right hand rotation (clockwise, as viewed from above) will tend to tighten, rather than loosen, the threaded engagement. The threaded engagement of the ends of rotor 70 with first and second attachment means 32 and 52 hold pump section 10 together.

Mounted on the exterior of cylindrical case 20, are a plurality of bow springs 90. The central portion of each bow spring has teeth on serrated portion 92 which bite into the cased (or uncased) wall of the wellbore to inhibit rotation. The ends of each bow spring have longitudinal slots 94 and are received in recesses 25 in the outer wall of cylindrical casing 20. Fasteners 96 pass through slots 94 and are received in threaded bores 27 in casing 20. Each recess 25 has a length that exceeds that of the portion of bow spring 90 that contains slot 94 (as best seen in FIG. 2). Slots 94 in combination with over-sized recesses 25 permit the bow springs 90 to partially collapse as necessary within the cased wellbore. The bow springs 90 need to be structurally substantial to prevent rotation of the stator housing and yet some flexibility is required. In addition, the slots permit a single diameter pump to be usable with several sizes of wellbore. It will be understood that the bow strings are exemplary of rotation inhibiting structure useful with the pump of the present invention.

In operation, the discharge port 16, an appropriate length of sediment holding chamber 14, check valve 12 and pumping section 10 are threadingly secured to drill string 17 and to one another, seriatim. A drill bit 19 or similar tool is secured to the lower end of pumping section 10 by threadingly engaging second attachment means 52. The drill string is lowered into the wellbore to the vicinity of the obstruction and an adequate amount of drilling fluid pumped downhole outside or inside the drill string in sufficient quantity for proper cooling of the bit and for circulation through the pump.

Drill string 17 is rotated in the normal manner. Teeth on serrated portion 92 engage the wellbore casing and prevent the pumping section 10 from rotating. The first attachment means 32 rotates with drill string 17 and, by virtue of its threaded connection with rotor 70, causes it to rotate, as well. Rotor 70, in turn, transmits rotational force to second attachment sleeve 52 and drill bit 19 which it carries by the engagement of laterally extending teeth 82 on sliding sprocket 80 in keyways 68.

The rotor 70 (which is also equipped with a right-handed helix) in cooperation with stator 22, pumps cuttings-ladened drilling fluid upwardly through throughbores 86, the cylindrical casing 20, and out throughbores 50 to check valve 12. Fluid seals 36 and 56 permit relative rotation between the first and second attachment sleeves and the pump casing 20 while preventing fluid leakage into or out of the pump 10. Any axial loading resulting from the drilling operation is passed from the second attachment sleeve to the cylindrical casing 20 through the bearings in races 60 and 64 and from casing 20 into the first attachment sleeve through the bearings in races 40 and 44. There is no axial loading of rotor 70 due to the ability of the teeth 82 of sliding sprocket 80 to move axially in keyways 68. This prevents binding of the rotor and excessive stator wear that might otherwise result if the rotor were compressively loaded.

Check valve 12 restricts the flow of cuttings-ladened drilling fluid to a direction up to the drill string. In the sediment holding chamber 14, the cuttings, being heavier, settle to the bottom while the drilling fluid is circulated to the top and out the discharge port(s) in section 16. The settled cuttings cannot clog check valve 12 due to the nature of the positive displacement pump which physically impels the fluids upwardly, producing a self-clearing action for the pump-valve combination.

Should the function of the pump become impaired as a result of stator wear, the stator can be easily replaced between uses. Slide sprocket 80 and second attachment sleeve 52 are removed from the lower end of rotor 70 and the rotor is pulled. Then, set screws 28 and 30 are backed out and one of the retaining rings 24 or 26 removed such that the stator 22 can be replaced. Although the stator is the one component subject to significant wear, various other components such as seals 36 and 56, slide sprocket 80, bow springs 90, and eventually, elements such as rotor 70 and first and second attachment sleeves 32 and 52 can all be replaced as wear and tear requires without the need for an entire pump replacement.

Various alternatives, changes and modifications will be apparent to the person of ordinary skill in the art following a reading of the foregoing description. It is, therefore, intended that all such alternatives, changes and modifications as fall within the scope of the appended claims be considered part of the present invention. Further, although the downhole circulation pump has been principally described in connection with drilling and milling operations, it will be appreciated that this pump may be used in connection with the downhole circulation of any fluid.

I claim:

1. A positive displacement pump for circulating fluid downhole in and around the lower most end of a drill string, or the like, said displacement pump comprising:

(a) a cylindrical casing having an outer diameter which is generally equal to that of said drilling string, (b) stator means housed within and secured to said cylindrical casing, (c) first attachment means for securing said cylindrical casing to an upper element in the drill string positioned above said cylindrical casing to maintain axial alignment and longitudinal position of said cylindrical casing with respect to said upper element while pemitting rotational displacement relative thereto, (d) second attachment means for securing said cylindrical casing to a lower element in the drill string such as a drill bit, or the like, positioned below said cylindrical casing to maintain axial alignment and longitudinal position of said cylindrical casing with respect to said lower element while permitting rotational displacement relative thereto, (e) means secured to the exterior of said cylindrical casing to inhibit rotation thereof in a wellbore, (f) a rotor positioned within and coacting with said stator to perform said pumping action, (g) means connecting one end of said rotor to said first attachment means, said first attachment means transmitting rotational force from said drill string to said rotor, (h) means connecting the other end of said rotor to said second attachment means, said second attachment means transmitting rotational force from said rotor to said lower element, (i) at least one discharge port positioned above said cylindrical casing in said drill string to permit the fluid to be recirculated to the lowermost end of said drill string.

2. The circulating pump of claim 1 wherein said rotor and said stator form a progressing cavity fluid displacement pump.

3. The circulating pump of claim 1 wherein said first attachment means comprises a first rotatable sleeve for threadingly engaging said upper element.

4. The circulating pump of claim 3 wherein said first attachment means further comprises a first lateral seal engaging an external portion of said first rotatable sleeve and an interior portion of said cylindrical casing.

5. The circulating pump of claim 4 wherein said first attachment means further comprises an axial thrust bearing engaging a laterally projecting, downwardly facing surface of said first rotatable sleeve and an upper end surface of said cylindrical casing.

6. The circulating pump of claim 1 wherein said second attachment means comprises a second rotatable sleeve for threadingly engaging said lower element.

7. The circulating pump of claim 6 wherein said second attachment means further comprises a second lateral seal engaging an external portion of said second rotatable sleeve and an interior portion of siad cylindrical casing.

8. The circulating pump of claim 7 wherein said second attachment means comprises an axial thrust bearing engaging a laterally-projecting, upwardly-facing surface of said second rotatable section and a lower end surface of said cylindrical casing.

9. The circulating pump of claim 1 wherein said means attached to the exterior of said casing to inhibit rotation comprise a plurality of bow springs, said attachment including means facilitating compression of said springs.

10. The circulating pump of claim 9 wherein said means facilitating compression of said springs includes threaded fasteners engaging in axially oriented slots.

11. The circulating pump of claim 1 wherein said means for connecting said other end of the rotor to said second attachment means includes a sliding sprocket to permit limited axial displacement between said other end of said rotor and said second attachment means to avoid axial compression of said rotor during operation of said pump.

12. The circulating pump of claim 11 wherein said sliding sprocket has throughbores therein to permit the cuttings-ladened fluid to pass axially therethrough from said drill bit into said stator of said pump.

13. The circulating pump of claim 1 further comprising a check valve situated within said drill string intermediate said cylindrical casing and said discharge port, said check valve permitting fluid flow only in a direction toward said discharge port.

14. The circulating pump of claim 13 wherein the means for connecting one end of said rotor to said first attachment means includes throughbores therein to permit cuttings-ladened fluid to pass axially therethrough from said stator to said check valve.

15. The circulating pump of claim 13 further comprising a sediment holding chamber positioned in said drill string intermediate said check valve and said discharge port.

16. A method of circulating drilling fluid downhole and around a cutting tool positioned at the lowermost end of a drill string, or the like, said method comprising the steps of pumping said drilling fluid downhole to facilitate drilling by cooling said cutting tool and by carrying away cuttings resulting therefrom, utilizing a positive displacement pump to reverse circulate said cuttings-laden drilling fluid through said positive displacement pump and upwardly into said drill string, allowing said cuttings to settle out of said drilling fluid in a sediment holding chamber positioned above said positive displacement pump, pumping said drilling fluid out a discharge port positioned above said sediment settling chamber enabling said fluid to be recirculated to said cutting tool at the lowermost end of said drill string.

17. A progressive cavity fluid displacement pump utilized to circulate fluid in a wellbore downhole, the circulating pump including a rotor having two ends and a stator, the improvement comprising:

(a) first means interconnecting one end of said rotor to a rotatable casing, said first interconnecting means including means preventing relative rotation between said rotor and said rotatable casing, (b) means to prevent rotation of the stator in said wellbore, (c) second means interconnecting the other end of said rotor to a tool to be rotated below said stator, said second interconnecting means including means preventing relative rotation between said rotor and said tool and means for preventing compressive axial loading of said rotor during utilization of said fluid displacement pump, such that rotational force is transmitted from said rotatable casing to said tool by means of said rotor.

* * * * *